US011712074B2

(12) United States Patent
Wagner

(10) Patent No.: US 11,712,074 B2
(45) Date of Patent: Aug. 1, 2023

(54) RESPIRATORY HALF MASK

(71) Applicant: UVEX ARBEITSSCHUTZ GMBH, Fuerth (DE)

(72) Inventor: Wolf Wagner, Cadolzburg (DE)

(73) Assignee: UVEX ARBEITSSCHUTZ GMBH, Fürth (DE)

( * ) Notice: Subject to any disclaimer, the term of this patent is extended or adjusted under 35 U.S.C. 154(b) by 856 days.

(21) Appl. No.: 16/619,184

(22) PCT Filed: Jun. 14, 2018

(86) PCT No.: PCT/EP2018/065766
§ 371 (c)(1),
(2) Date: Dec. 4, 2019

(87) PCT Pub. No.: WO2019/001973
PCT Pub. Date: Jan. 3, 2019

(65) Prior Publication Data

US 2020/0113256 A1 Apr. 16, 2020

(30) Foreign Application Priority Data

Jun. 30, 2017 (DE) ..... 10 2017 211 182.8

(51) Int. Cl.
*A41D 13/11* (2006.01)
*A62B 23/02* (2006.01)

(52) U.S. Cl.
CPC ..... *A41D 13/1115* (2013.01); *A41D 13/1161* (2013.01); *A62B 23/025* (2013.01)

(58) Field of Classification Search
CPC ..... A41D 13/1115; A41D 13/1161; A41D 13/1123; A62B 23/025
See application file for complete search history.

(56) References Cited

U.S. PATENT DOCUMENTS 4,688,566 A * 8/1987 Boyce ..... A41D 13/1123 128/206.19
5,701,893 A * 12/1997 Kern ..... A62B 23/025 128/206.19

(Continued)

FOREIGN PATENT DOCUMENTS

WO 9628216 A1 9/1996
WO 2011142487 A1 11/2011

*Primary Examiner* — Camtu T Nguyen
(74) *Attorney, Agent, or Firm* — Browdy and Neimark, PLLC

(57) ABSTRACT

A respiratory half mask having a respiratory half mask body with a basic part for covering the mouth of the wearer and two side fields, which are situated opposite one another and are fixed in a folded-over position to the basic part for receiving a head holding portion on the wearer upon forming head holding portion receptacles. The respiratory half mask body includes a nose part fixedly connected to the basic part and foldable between a nose part wearing position and a nose part storing position and including at least two nose part part-recesses. The respiratory half mask body includes a chin part fixedly connected to the basic part and foldable between a chin part wearing position and a chin part storing position and comprising chin part part-recesses. The part-recesses serve for preventing the folded-over side fields fixing to the chin part and nose part upon fixing the side fields to the basic part.

23 Claims, 3 Drawing Sheets

(56) References Cited

U.S. PATENT DOCUMENTS

| | | | | |
|---|---|---|---|---|
| 6,886,563 | B2 | 5/2005 | Bostock et al. | |
| 8,251,065 | B2 * | 8/2012 | Kim | A41D 13/1115 128/206.19 |
| 2004/0069302 | A1 | 4/2004 | Wilson et al. | |
| 2011/0155138 | A1 | 6/2011 | Lin | |

* cited by examiner

RESPIRATORY HALF MASK

CROSS-REFERENCE TO RELATED APPLICATIONS

This application claims the priority of German Patent Application Serial No. DE 10 2017 211 182.8, filed on Jun. 30, 2017, pursuant to 35 U.S.C. 119(a)-(d), the content of which is incorporated herein by reference in its entirety as if fully set forth herein.

FIELD OF THE INVENTION

The invention relates to a respiratory half mask for filtering breathing air of a wearer of the respiratory half mask. In addition, the invention is focused on a method for producing such a respiratory half mask.

BACKGROUND OF THE INVENTION

WO 2011/142487 A1 discloses a generic foldable respiratory half mask made of a fleece laminate. The mask comprises a base body and a foldable nose part related to the base body as well as a chin part. Furthermore, the mask has two side fields which are folded onto the base body when the mask is in a finished state and form a head strap guide.

A further generic respiratory half mask is previously known, for example, from WO 96/28216 A1

US 2004/0069302 A1 discloses a respiratory half mask which is transferable from a folded position into a wearing position. An upper nose part and a lower chin part of the respiratory half mask are connected via weld seams to a basic part of the respiratory half mask.

US 2011/0155138 A1 discloses a further respiratory half mask of the prior art which is realized as a folding mask. The respiratory half mask has a basic part on which an upper nose part and a lower chin part are arranged.

SUMMARY OF THE INVENTION

An object underlying the invention is to provide an improved respiratory half mask. In particular, the respiratory half mask is to be extremely user-friendly or simple to produce. A corresponding production method is also to be created.

Said object is achieved according to the invention by a respiratory half mask for filtering breathing air of a wearer of the respiratory half mask, having a respiratory half mask body, which comprises a flexible basic part for covering the mouth of the wearer, two side fields, which are situated opposite one another and are fixed in a folded-over position to the basic part upon forming head holding means receptacles for receiving at least one head holding means for holding the respiratory half mask body on the wearer, a flexible nose part which is fixedly connected to the basic part for covering the nose of the wearer, wherein the nose part is foldable in relation to the basic part between a nose part wearing position and a nose part storing position, and comprises at least two, in particular edge-side, nose part part-recesses for preventing the folded-over side fields fixing to the nose part upon fixing the side fields to the basic part, and a flexible chin part which is fixedly connected to the basic part for covering the chin of the wearer, wherein the chin part is foldable in relation to the basic part between a chin part wearing position and a chin part storing position, and comprises at least two, in particular edge-side, chin part part-recesses for preventing the folded-over side fields fixing to the chin part upon fixing the side fields to the basic part.

Furthermore, said object is achieved according to the invention by a method for producing an inventive respiratory half mask including the steps providing a respiratory half mask body with a flexible basic part for covering the mouth of the wearer and with a flexible nose part, which is fixedly connected to the basic part, for covering the nose of the wearer and with a flexible chin part which is fixedly connected to the basic part for covering the chin of the wearer, wherein the nose part is foldable in relation to the basic part between a nose part wearing position and a nose part storing position, wherein the chin part is foldable in relation to the basic part between a chin part wearing position and a chin part storing position, folding over two oppositely situated side fields of the respiratory half mask upon forming head holding means receptacles for at least one head holding means for holding the respiratory half mask on the head of the wearer, and fixing the side fields in their folded-over position to the basic part, wherein the nose part comprises at least two, in particular edge-side, nose part part-recesses for preventing the folded-over side fields fixing to the nose part upon fixing the side fields to the basic part, wherein the chin part comprises at least two, in particular edge-side, chin part part-recesses for preventing the folded-over side fields fixing to the chin part upon fixing the side fields to the basic part.

The core consists in that by means of the part-recesses, unwanted fixing of the folded-over or folded-in side fields on the nose part and chin part when producing the respiratory half mask can be reliably prevented. A, in particular full, folding of the nose part and chin part from the, advantageously flat, storing position into the respective, advantageously folded-open, wearing position is thus possible in a simple and problem-free manner, which results in particularly good protection of the wearer of the respiratory half mask. Leaks of or damage to the respiratory half mask, in particular when fixing the side fields to the basic part, are reliably avoidable.

It is advantageous when the basic part and the chin part extend adjacent or parallel to one another in the chin part storing position. The basic part and the nose part advantageously extend adjacent or parallel to one another in the nose part storing position. When the chin part and the nose part are each situated in the storing position, the respiratory half mask is in particular flat. The respiratory half mask then assumes a storing position in particular itself.

When, in contrast, the chin part and nose part are each situated in the wearing position, the respiratory half mask is preferably dish-like. The respiratory half mask then assumes a wearing position in particular itself. It is expedient when the basic part, nose part and/or chin part include at least one stiffening means, such as a seam, clip or the like.

The respiratory half mask is preferably realized as a folding or hinged mask. It is advantageous when the respiratory half mask is symmetrical with reference to a center plane. As an alternative to this, the respiratory half mask is asymmetrical.

The basic part, nose part and/or chin part are each preferably multi-layered. As an alternative to this, the basic part, nose part and/or chin part are each single-layered.

The basic part, nose part and chin part are advantageously formed from an identical material. It is advantageous when the respiratory half mask is formed from a filter material. The filter material is, for example, a non-woven material and advantageously enables breathing directly through the same.

The filter material filters the breathing air. It is advantageous when the respiratory half mask has a particle filter or is usable with gases and steam.

The respiratory half mask can have at least one inhalation valve and/or exhalation valve. When at least one inhalation valve and/or exhalation valve is present, the basic part, nose part and/or chin part can be formed from an air-impermeable material.

In an advantageous manner, the basic part, nose part and chin part are already originally connected together in one piece and communicate with one another, for example, by means of hinged lines or fold lines. As an alternative to this, the basic part, nose part and chin part are, for example, originally realized separately and are then joined together to form the respiratory half mask. A seam can be used, for example, for joining them together.

The at least one head holding means is realized, for example, as a strap, cord or the like. It is formed, for example, from rubber or textile. It is advantageous when the length of the at least one head holding means is adjustable.

The head holding means receptacles are advantageously fully closed circumferentially. They are preferably open at the end. The at least one head holding means is advantageously guided in the head holding means receptacles, in particular so as to be displaceable. It is preferably guided through them, in particular so as to be displaceable.

The at least one material bond fixing point via which each of the side fields is fixed, in particular exclusively, to the basic part for holding the same in the folded-over position thereof, is advantageously a non-releasable connection. It is preferably in the form of a dot and/or line. It is advantageous when the at least one material bond fixing point is formed by welding, in particular ultrasound welding, or bonding. A material bond fixing point is preferably generated as a result of heat and/or pressure. It is advantageous when the side fields and/or the basic part are temporarily softened or melted in regions for fastening to one another. The fixed connection between the basic part and the respective side field is preferably generated when it has cooled down.

The dimensions of the nose part part-recesses, wherein each of the nose part part-recesses comprise a length LN, which is between 5 mm and 20 mm, in the circumferential direction of the nose part and further comprise a width BN, which is between 2 mm and 8 mm, perpendicular to a circumferential direction of the nose part, allow reliable prevention of the folded-over side fields becoming fixed to the nose part. Conversely, they allow reliable fixing of the side fields to the basic part.

The dimensions of the chin part part-recesses, wherein each of the chin part part-recesses comprise a length LK, which is between 5 mm and 20 mm, in circumferential direction of the chin part and further comprise a width BK, which is between 2 mm and 8 mm, perpendicular to a circumferential direction of the chin, allow reliable prevention of the folded-over side fields becoming fixed to the chin part. Conversely, they allow reliable fixing of the side fields to the basic part.

In each case two of the nose part part-recesses and chin part part-recesses are arranged in pairs or adjacent to one another in the storing positions of the chin part and nose part and form whole recesses. The respective nose part part-recesses and chin part part-recesses then supplement one another in a preferred manner and merge into one another in order to form the whole recesses.

A preferred embodiment of the invention is described below as an example with reference to the accompanying drawings.

DESCRIPTION OF THE PREFERRED EMBODIMENT

Figure 1:
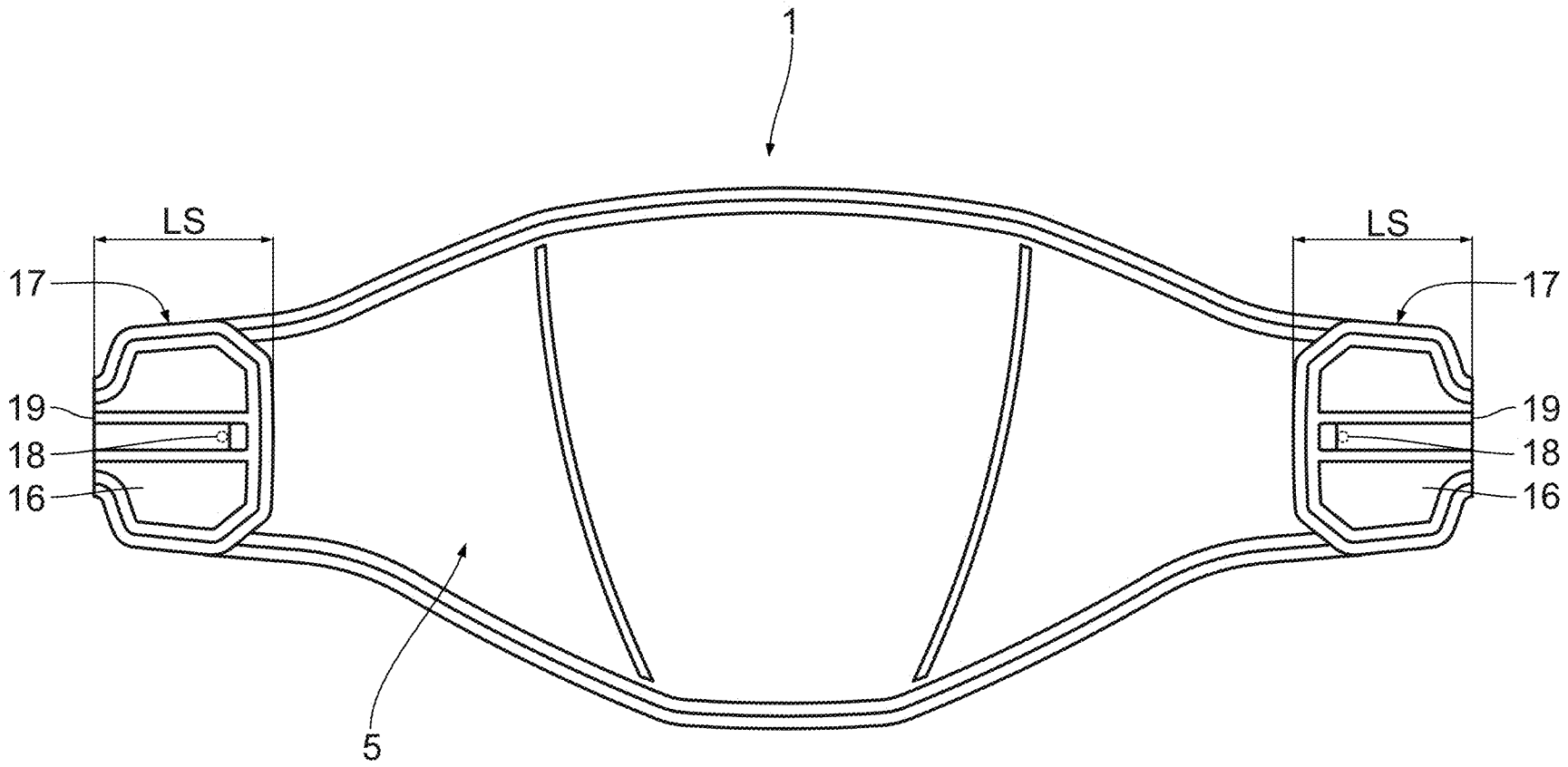
FIG. 1 shows a front view of a respiratory half mask according to the invention in a flat storing position.
Figure 2:
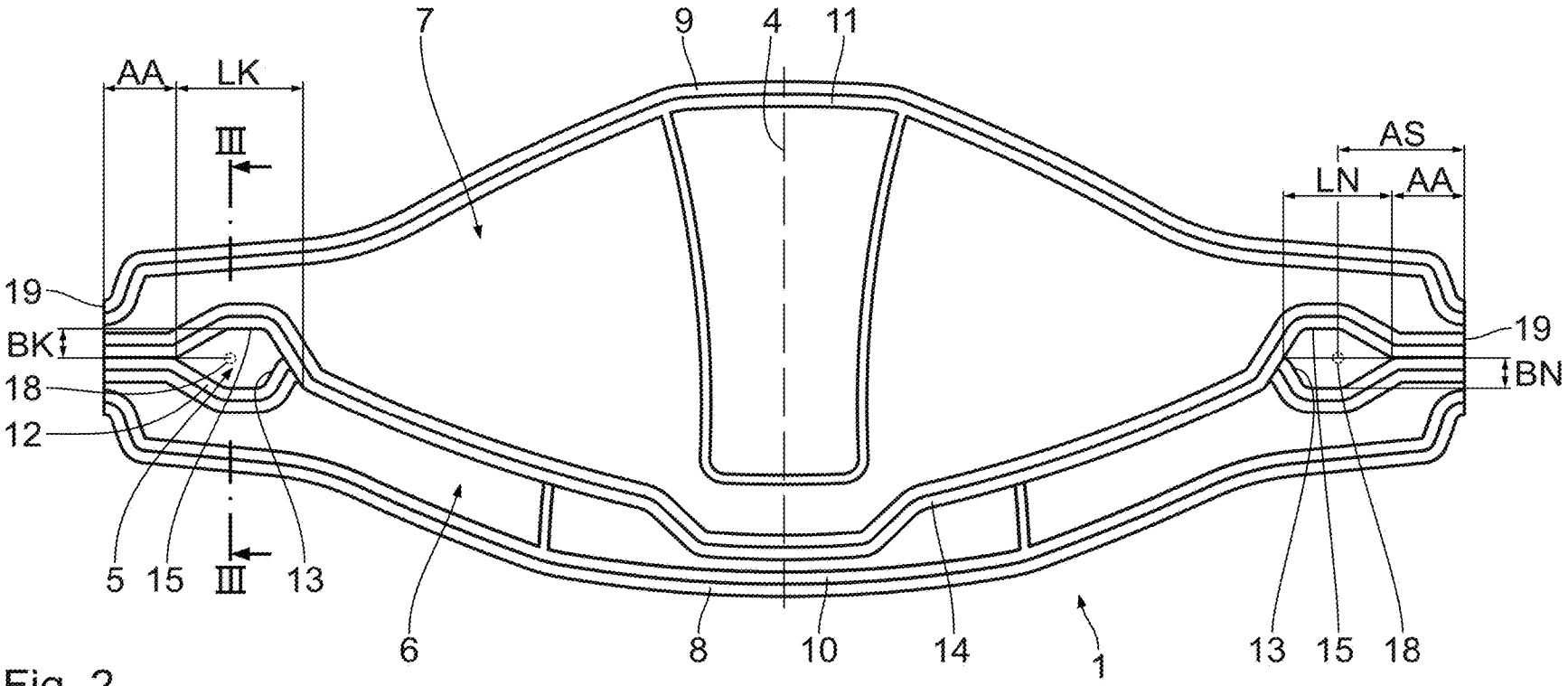
FIG. 2 shows a rear view of the respiratory half mask shown in FIG. 1.
Figure 3:
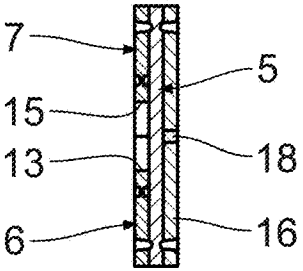
FIG. 3 shows a sectional view corresponding to the cutting line III-III shown in FIG. 2.
Figure 4:
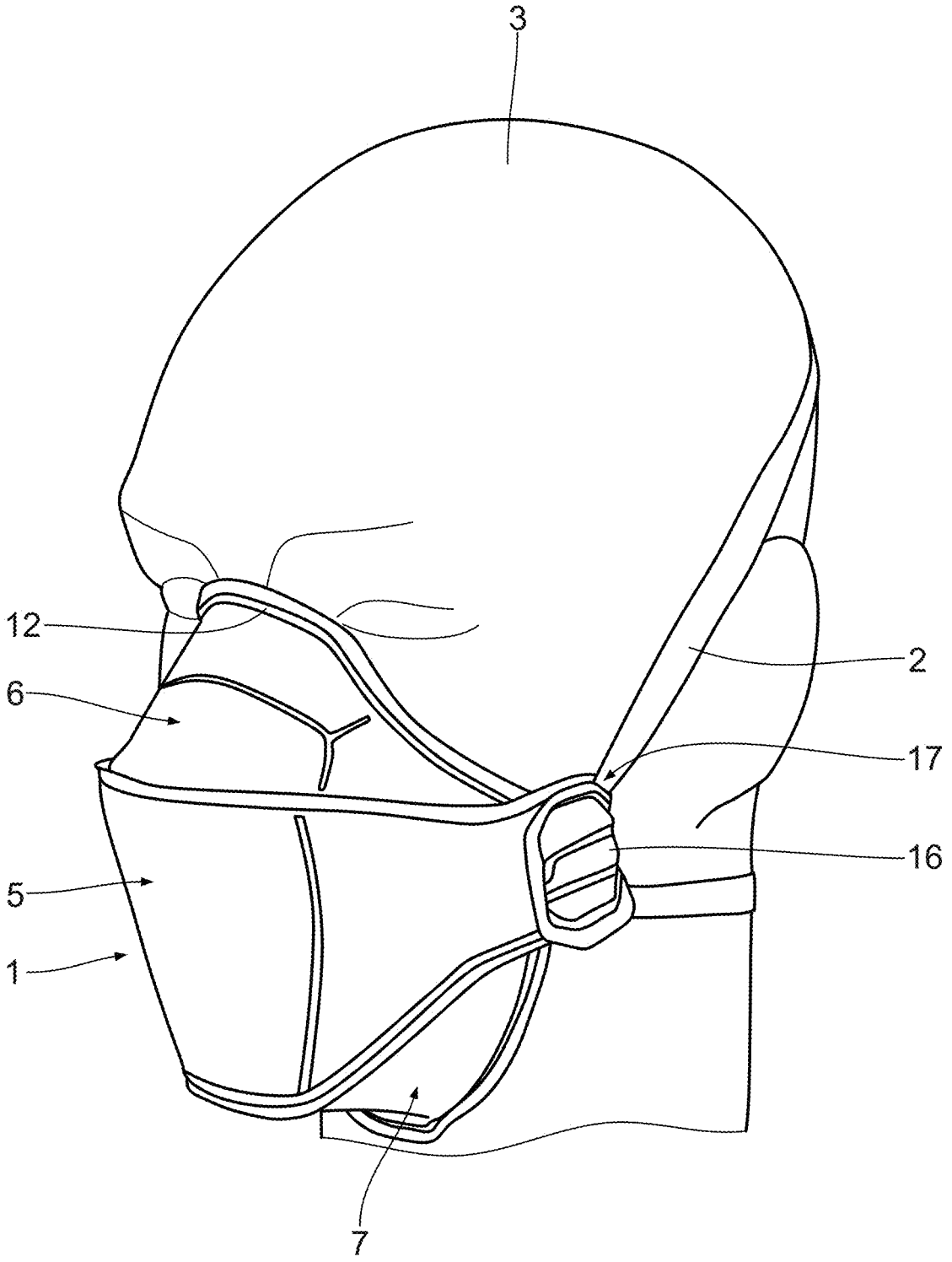
FIG. 4 shows a perspective view which illustrates the respiratory half mask shown in FIGS. 1, 2 being worn in the wearing position.

A respiratory half mask shown in the figures includes a respiratory half mask body 1 and a head strap 2 arranged on the respiratory half mask body 1 for holding the respiratory half mask body 1 on a head 3 of a wearer. As shown in FIGS. 1, 2, the respiratory half mask body 1 is realized symmetrically with reference to a center plane 4.

The respiratory half mask body 1 includes a basic part 5 and a nose part 6 which is arranged on the basic part 5 and a chin part 7 which is arranged on the basic part 5.

The basic part 5 has an upper edge region 8 and a lower edge region 9 which extends situated opposite the upper edge region 8 and is arranged at a spacing from said upper edge region. The nose part 6 connects to the upper edge region 8, whilst the chin part 7 connects to the lower edge region 9. The nose part 6 is advantageously arranged on the basic part 5 by means of an upper weld seam 10 adjacent to the upper edge region 8, whilst the chin part 7 is preferably arranged on the basic part 5 by means of a lower weld seam 11 adjacent to the lower edge region 9. It is expedient when the edge regions 8, 9 extend together or toward one another proceeding from the center plane 4.

The nose part 6 has a free sealing edge 12 which extends at a spacing from or oppositely situated to the basic part 5. The nose part 6 comprises two nose part part-recesses 13. The nose part part-recesses 13 are delimited spatially by the free sealing edge 12 and are open in regions circumferentially. To form the nose part part-recesses 13, the free sealing edge 12 projects in regions onto the upper edge region 8. The nose part part-recesses 13 are open opposite the upper edge region 8. They penetrate the nose part 6 fully.

Each nose part part-recess 13 has a length LN, which is between 5 mm and 20 mm, in the circumferential direction of the nose part 6, and perpendicular to the length LN a width BN which is between 2 mm and 8 mm.

The chin part 7 has a free sealing edge 14 which extends at a spacing from or opposite to the basic part 5. In addition, the chin part 7 has two chin part part-recesses 15. The chin part part-recesses 15 are delimited spatially by the free sealing edge 14 and are open in regions circumferentially. To form the chin part part-recesses 15, the free sealing edge 14 projects in regions onto the lower edge region 9. The chin part part-recesses 15 are open opposite the lower edge region 9. They penetrate the chin part 7 fully.

Each chin part part-recess 15 has a length LK, which is between 5 mm and 20 mm, in the circumferential direction of the chin part 7, and perpendicular to the length LK a width BK which is between 2 mm and 8 mm.

The basic part 5, the nose part 6 and the chin part 7 have an identical width perpendicular to the center plane 4.

The respiratory half mask body 1 additionally has two oppositely situated front side fields 16 which extend adjacent to the basic part 5 upon forming side head strap receptacles 17. Each side field 16 is welded onto the basic part 5 by means of a punctiform weld fixing point 18. Each side field 16 is fixed locally to the basic part 5 in a folded-over position by means of the weld fixing point 18. It is delimited at the side by a folding-over line 19 which extends substantially parallel to the center plane 4. Each folding-over line 19 extends at a spacing to the adjacent weld fixing point 18.

In the storing position, the rear of the nose part 6 abuts flatly against the basic part 5, whilst the rear of the chin part 7 then overlaps the basic part 5 and in regions the nose part 6. In the storing position, the rear of the chin part 7 abuts flatly against the nose part 6. The free sealing edge 14 of the chin part 7 then extends adjacent to the upper edge region 8, whilst the free sealing edge 12 of the nose part 6 then extends adjacent to the lower edge region 9.

Thus, two whole recesses are formed by the part-recesses 13, 15 with the respiratory half mask in the storing position. Each whole recess is formed by a nose part part-recess 13 and a chin part part-recess 15. Each whole recess is quasi closed circumferentially.

Each whole recess is at a spacing AA from the adjacent folding line 19. Each weld fixing point 18 is at a distance AS, which is greater than the distance AA but smaller than the sum of the distance AA and the length LN or LK, from the adjacent folding line 19.

The production method of the respiratory half mask is described below. To form the respiratory half mask body 1, the nose part 6 and the chin part 7 are welded to the basic part 5 with linear weld seams. The nose part 6 and chin part 7 and basic part 5 are preferably situated, in this case, in an arrangement overlapping one another corresponding to FIG. 2. As an alternative to this, a respiratory half mask body 1, which encloses the nose part 6, the chin part 7 and the basic part 5, is produced directly from a corresponding material, in particular from a multi-layered non-woven material or composite material. In particular, for forming the respiratory half mask body 1, the nose part 6 and the chin part 7 and the basic part 5 are produced, for example, directly from a composite made from a multi-layered non-woven material by means of weld seams and aligning the different layers of non-woven material.

The respiratory half mask body 1 is then folded forward forming the side fields 16 upon forming the folding-over lines 19 so that the side fields 16 abut against the front of the basic part 5. Each side field 16 has a length LS, which is greater than the distance AS, proceeding from the adjacent folding-over line 19. Each side field 16 consequently overlaps or engages over the whole recesses at least in part on a side of the basic part 5 remote from the whole recesses.

The side fields 16 are then welded on the basic part 5 by means of a welding device (not shown) in their folded-over position upon forming the head strap receptacles 17. Each weld fixing point 18 generated and the adjacent folding-over line 19 delimit the respective head strap receptacle 17 at the side. The weld fixing points 18 are arranged adjacent to the whole receptacle or quasi inside. The nose part 6 and the chin part 7 extend at a spacing to the weld fixing points 18. Even when, therefore, as a result of the welding of the side fields 16, the basic part 5 is melted over its entire thickness, an unwanted weld connection is not present between the basic part 5 and the nose part 6 and/or chin part 7 as only the whole receptacles and not material of the nose part 6 and/or chin part 7 is/are situated there. Such an unwanted weld connection between the basic part 5 and nose part 6 and/or chin part 7 would prevent the respiratory half mask being transferred into its wearing position. It is then impossible to fold the respiratory half mask fully open. Such an unwanted weld connection would possibly also lead to damage to the respiratory half mask at the weld connection when it was folded open as the respiratory half mask would be torn at the weld connection when it was folded open.

The head strap 2 is then threaded through the head strap receptacles 17.

For use, the respiratory half mask body 1 is transferred from its storing position or its production position into a wearing position. To this end, the respiratory half mask body 1 is folded open or hinged open. The sealing edge 14 of the chin part 7 is lifted from the basic part 5, the chin part 7 being folded open or hinged open in relation to the basic part 5. The sealing edge 12 of the nose part 6 is lifted from the basic part 5, the nose part 6 being folded open or hinged open in relation to the basic part 5. The nose part 6 is folded about the upper weld seam 10 whilst the chin part 7 is folded about the lower weld seam 11. The respiratory half mask is then dish-like and delimits an interior.

In the wearing position, the free sealing edge 12 of the nose part 6 abuts sealingly against the nose and the cheek areas of the wearer, whilst the free sealing edge 14 of the chin part 7 abuts sealingly against the chin of the wearer. The side fields 16 are arranged remote from the wearer and adjacent to the cheeks of the wearer.

The invention claimed is:

1. A respiratory half mask for filtering breathing air of a wearer of the respiratory half mask, a) having a respiratory half mask body, which comprises i. a flexible main portion for covering the mouth of the wearer, ii. two side portions, each of which is situated opposite one another and is fixed in a folded-over position to the flexible main portion thereby forming receptacles for receiving at least one strap for holding the respiratory half mask body on the wearer, iii. a flexible nose portion which is fixedly connected to the flexible main portion for covering the nose of the wearer, wherein the flexible nose portion is foldable in relation to the flexible main portion between a wearing position and a storing position, and wherein the flexible nose portion comprises at least two nose portion part-recesses for preventing the two side portions from becoming fixed to the flexible nose portion when the two side portions are fixed to the flexible main portion, and iv. a flexible chin portion which is fixedly connected to the flexible main portion for covering the chin of the wearer, wherein the flexible chin portion is foldable in relation to the flexible main portion between a wearing position and a storing position, and wherein the flexible chin portion comprises at least two chin portion part-recesses for preventing the two side portions from becoming fixed to the flexible chin portion when the two side portions are fixed to the flexible main portion.

2. The respiratory half mask as claimed in claim 1, wherein the flexible nose portion comprises at least two edge-side nose portion part-recesses for preventing the two side portions from being fixed to the flexible nose portion when the two side portions are fixed to the flexible main portion.

3. The respiratory half mask as claimed in claim 1, wherein the flexible chin portion comprises at least two edge-side chin portion part-recesses for preventing the two side portions from being fixed to the flexible chin portion when the two side portions are fixed to the flexible main portion.

4. The respiratory half mask as claimed in claim 1, wherein the flexible nose portion and the flexible chin portion are fixedly connected to edge regions of the flexible main portion, wherein the edge regions are situated opposite one another.

5. The respiratory half mask as claimed in claim 1, wherein each of the two side portions is fixed to the flexible main portion for holding the each of the two side portions in the folded-over position thereof via at least one material bond fixing point.

6. The respiratory half mask as claimed in claim 1, wherein each of the two side portions is fixed exclusively to the flexible main portion for holding the each of the two side portions in the folded-over position thereof via at least one material bond fixing point.

7. The respiratory half mask as claimed in claim 1, wherein each of the nose portion part-recesses comprises a length LN, which is between 5 mm and 20 mm, in a circumferential direction of the flexible nose portion.

8. The respiratory half mask as claimed in claim 1, wherein each of the nose portion part-recesses comprises a width BN, which is between 2 mm and 8 mm, perpendicular to a circumferential direction of the flexible nose portion.

9. The respiratory half mask as claimed in claim 1, wherein the flexible main portion is exposed in a region of the nose portion part-recesses when the flexible nose portion is situated in the storing position.

10. The respiratory half mask as claimed in claim 1, wherein the flexible basic portion is exposed on a rear side in the region of the nose portion part-recesses when the flexible nose portion is situated in the storing position.

11. The respiratory half mask as claimed in claim 1, wherein the two side portions extend in the folded-over position remote from the flexible nose portion at least in part over the nose portion part-recesses when the flexible nose portion is situated in the storing position.

12. The respiratory half mask as claimed in claim 1, wherein each of the chin portion part-recesses comprise a length LK, which is between 5 mm and 20 mm, in a circumferential direction of the flexible chin portion.

13. The respiratory half mask as claimed in claim 1, wherein each of the chin portion part-recesses comprise a width BK, which is between 2 mm and 8 mm, perpendicular to a circumferential direction of the flexible chin portion.

14. The respiratory half mask as claimed in claim 1, wherein the flexible main portion is exposed in a region of the chin portion part-recesses when the flexible chin portion is situated in the storing position.

15. The respiratory half mask as claimed in claim 14, wherein the flexible main portion is exposed on a rear side in a region of the chin portion part-recesses when the flexible chin portion is situated in the storing position.

16. The respiratory half mask as claimed in claim 1, wherein the two side portions extend in the folded-over position remote from the flexible chin portion at least in part over the chin portion part-recesses when the flexible chin portion is situated in the storing position.

17. The respiratory half mask as claimed in claim 1, wherein in each case two of the nose portion part-recesses and the chin portion part-recesses are arranged adjacent to one another in the storing positions of the flexible chin portion and of the flexible nose portion and form whole recesses.

18. The respiratory half mask as claimed in claim 1, comprising at least one strap which is received in the receptacles.

19. A method for producing an inventive respiratory half mask comprising the steps:

providing a respiratory half mask body with a flexible main portion for covering the mouth of the wearer, a flexible nose portion, which is fixedly connected to the flexible main portion, for covering the nose of the wearer, a flexible chin portion which is fixedly connected to the flexible main portion for covering the chin of the wearer, and two side portions, each of which are situated opposite one another, wherein the flexible nose portion is foldable in relation to the flexible main between a nose portion wearing position and a nose portion storing position, wherein the flexible chin portion is foldable in relation to the flexible main portion between a chin portion wearing position and a chin portion storing position, folding over the side portions of the respiratory half mask body into a folded-over position, and fixing the two side portions in the folded-over position to the flexible main portion after forming receptacles for at least one strap for holding the respiratory half mask on the head of the wearer, wherein the flexible nose portion comprises at least two nose portion part-recesses for preventing the two folded-over side portions from becoming fixed to the flexible nose portion when the side portions are fixed to the flexible main portion, wherein the flexible chin portion comprises at least two chin portion part-recesses for preventing the two folded-over side portions from becoming to the flexible chin portion when the two side portions are fixed to the flexible main portion.

20. The method as claimed in claim 19, wherein the flexible nose portion comprises at least two edge-side nose portion part-recesses for preventing the two folded-over side portions from becoming fixed to the flexible nose portion when the two side portions are fixed to the flexible main portion.

21. The method as claimed in claim 19, wherein the flexible chin portion comprises at least two edge-side chin portion part-recesses for preventing the two folded-over side portions from becoming fixed to the flexible chin portion when the two side portions are fixed to the flexible main portion.

22. The method as claimed in claim 19, further comprising situating at least one of a group comprising the flexible nose portion and the flexible chin portion in a respective storing position prior to the fixing of the two side portions in the folded-over position to the flexible main portion.

23. The method as claimed in claim 19, wherein upon fixing the two side portions to the flexible main portion, the flexible main portion is arranged in regions between the two folded-over side portions and at least one of the group comprising the flexible nose portion situated in the flexible nose portion storing position and the flexible chin portion situated in the flexible chin portion storing position.

* * * * *